US011980789B2

(12) United States Patent
Lagree et al.

(10) Patent No.: US 11,980,789 B2
(45) **Date of Patent: *May 14, 2024**

(54) EXERCISE MACHINE WITH ADJUSTABLE HANDLES

(71) Applicant: Lagree Technologies, Inc., Chatsworth, CA (US)

(72) Inventors: Sebastien Anthony Louis Lagree, Chatsworth, CA (US); Andy H. Gibbs, Oro Valley, AZ (US); Piotr Zin, Newbury Park, CA (US); Ross L Carmichael, Everett, WA (US); Johannes Lampela, Newbury Park, CA (US)

(73) Assignee: Lagree Technologies, Inc., Chatsworth (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/160,428

(22) Filed: Jan. 27, 2023

(65) Prior Publication Data

US 2023/0173338 A1 Jun. 8, 2023

Related U.S. Application Data

(63) Continuation of application No. 17/507,032, filed on Oct. 21, 2021, now Pat. No. 11,565,151, which is a (Continued)

(51) Int. Cl.
*A63B 22/20* (2006.01)
*A63B 22/00* (2006.01)
(Continued)

(52) U.S. Cl.
CPC ..... *A63B 22/203* (2013.01); *A63B 22/0015* (2013.01); *A63B 22/0046* (2013.01); (Continued)

(58) Field of Classification Search
CPC ..... A63B 21/4033; A63B 21/4035; A63B 21/4047; A63B 22/0015; A63B 22/0046; (Continued)

(56) References Cited

U.S. PATENT DOCUMENTS 1,621,477 A 3/1927 Pilates
2,223,309 A 4/1940 Swanson
(Continued)

FOREIGN PATENT DOCUMENTS

AU 2004200589 A1 3/2004
DE 19832235 A1 1/2000
WO 2004096376 A1 11/2004

*Primary Examiner* — Joshua Lee
(74) *Attorney, Agent, or Firm* — Neustel Law Offices

(57) ABSTRACT

An exercise machine with adjustable handles that provide for multiple handle positions. The exercise machine with adjustable handles generally includes a frame with one or more rails, a carriage movably positioned upon the rails, and a pair of adjustable handles positioned near an end of the frame. The adjustable handles each have a handle portion that is movably connected to a corresponding handle stanchion to pivot from a storage position to an extended position.

20 Claims, 12 Drawing Sheets

Related U.S. Application Data continuation of application No. 16/698,151, filed on Nov. 27, 2019, now Pat. No. 11,154,749, which is a continuation of application No. 15/789,304, filed on Oct. 20, 2017, now Pat. No. 10,493,321.

(60) Provisional application No. 62/410,823, filed on Oct. 20, 2016.

(51) Int. Cl.
*A63B 23/035* (2006.01)
*A63B 23/04* (2006.01)
*A63B 21/00* (2006.01)

(52) U.S. Cl.
CPC .... *A63B 22/0089* (2013.01); *A63B 23/03525* (2013.01); *A63B 23/0429* (2013.01); *A63B 21/4033* (2015.10); *A63B 21/4035* (2015.10); *A63B 21/4047* (2015.10); *A63B 22/20* (2013.01); *A63B 22/201* (2013.01); *A63B 2225/09* (2013.01)

(58) Field of Classification Search
CPC ... A63B 22/0089; A63B 22/20; A63B 22/201; A63B 22/203; A63B 23/03525; A63B 23/0429; A63B 2225/09
See application file for complete search history.

(56) References Cited

U.S. PATENT DOCUMENTS 3,770,267 A 11/1973 McCarthy
3,795,396 A 3/1974 Kropeinitski
3,892,404 A 6/1975 Martucci
4,226,415 A 10/1980 Wright
4,231,375 A 11/1980 Boehringer
4,397,462 A 8/1983 Willmarth
4,709,920 A 12/1987 Schnell
4,725,057 A 2/1988 Shifferaw
4,759,540 A 7/1988 Yu
4,798,378 A 1/1989 Jones
5,066,005 A 11/1991 Luecke
5,110,122 A 5/1992 Moore
5,139,471 A 8/1992 Dornberger
5,211,617 A 5/1993 Millen
5,263,913 A 11/1993 Boren
5,374,226 A 12/1994 Grahm
5,380,259 A 1/1995 Robertson
D362,700 S 9/1995 Breibart
D382,319 S 8/1997 Gerschefske
5,653,670 A 8/1997 Endelman
5,681,249 A 10/1997 Endelman
5,792,033 A 8/1998 Merrithew
5,830,115 A 11/1998 Chen
5,857,946 A 1/1999 Brown
5,885,197 A 3/1999 Barton
5,906,564 A 5/1999 Jacobsen
5,935,049 A 8/1999 Hamm
5,961,430 A 10/1999 Zuckerman
5,967,955 A 10/1999 Westfall
6,120,425 A 9/2000 Endelman
6,179,753 B1 1/2001 Barker
6,315,695 B1 11/2001 Foilett
6,338,704 B1 1/2002 Endelman
6,471,624 B1 10/2002 Voris
6,527,685 B2 3/2003 Endelman
6,595,902 B1 7/2003 Savage
6,651,281 B1 11/2003 Figiel
6,652,425 B1 11/2003 Martin
6,726,608 B1 4/2004 Hsu
6,805,409 B2 10/2004 Parker
6,971,976 B2 12/2005 Endelman
7,029,425 B2 4/2006 Krull
7,104,933 B1 9/2006 Liao
7,163,498 B1 1/2007 Abelbeck
7,163,500 B2 1/2007 Endelman
7,384,381 B2 6/2008 Webber
7,674,211 B2 3/2010 Uygan
7,682,297 B2 3/2010 Graham
7,803,095 B1 9/2010 Lagree
7,819,777 B1 10/2010 Service
7,931,570 B2 4/2011 Hoffman
7,942,799 B1 5/2011 Boyd
8,249,714 B1 8/2012 Hartman
8,585,554 B2 11/2013 Shavit
8,641,585 B2 * 2/2014 LaGree ..... A63B 22/203 482/92
9,522,299 B2 * 12/2016 Lagree ..... A63B 21/4029
9,586,081 B2 * 3/2017 Lagree ..... A63B 21/02
9,597,545 B1 * 3/2017 Lagree ..... A63B 21/023
10,046,193 B1 * 8/2018 Aronson ..... A63B 21/0407
2001/0056011 A1 12/2001 Endelman
2003/0119635 A1 6/2003 Arbuckle
2005/0130810 A1 6/2005 Sands
2005/0164856 A1 7/2005 Parmater
2006/0046914 A1 3/2006 Endelman
2006/0199712 A1 9/2006 Barnard
2006/0252613 A1 11/2006 Barnes
2007/0087921 A1 4/2007 Graham
2008/0070765 A1 3/2008 Brown
2008/0248935 A1 10/2008 Solow
2009/0048078 A1 2/2009 Marcantonio
2009/0108648 A1 4/2009 Biggs
2010/0227748 A1 9/2010 Campanaro
2011/0009249 A1 1/2011 Campanaro
2011/0143898 A1 6/2011 Trees
2011/0152032 A1 6/2011 Barnett
2011/0166002 A1 7/2011 Savsek
2011/0172069 A1 7/2011 Gerschefske
2012/0295771 A1 11/2012 Lagree
2013/0017935 A1 1/2013 Endelman
2013/0196835 A1 8/2013 Solow
2014/0011645 A1 1/2014 Johnson
2014/0100089 A1 4/2014 Kermath
2014/0121076 A1 5/2014 Lagree
2014/0121078 A1 5/2014 Lagree
2014/0121079 A1 5/2014 Lagree
2014/0141948 A1 * 5/2014 Aronson ..... A63B 22/0087 482/128
2015/0024914 A1 1/2015 Lagree
2015/0057127 A1 2/2015 Lagree
2015/0065318 A1 3/2015 Lagree
2015/0072841 A1 3/2015 Lagree
2015/0141204 A1 5/2015 Lagree
2015/0217164 A1 8/2015 Lagree
2015/0220523 A1 8/2015 Lagree
2015/0246263 A1 9/2015 Campanaro
2015/0297944 A1 10/2015 Lagree
2015/0343250 A1 12/2015 Lagree
2015/0360068 A1 12/2015 Lagree
2015/0360083 A1 12/2015 Lagree
2015/0360113 A1 12/2015 Lagree
2015/0364058 A1 12/2015 Lagree
2015/0367166 A1 12/2015 Lagree
2016/0008657 A1 1/2016 Lagree
2016/0059060 A1 3/2016 Lagree
2016/0059061 A1 3/2016 Lagree
2016/0096059 A1 4/2016 Lagree
2016/0166870 A1 6/2016 Lagree
2016/0193496 A1 7/2016 Lagree
2016/0256733 A1 9/2016 Lagree
2016/0271452 A1 9/2016 Lagree
2016/0317858 A1 11/2016 Lagree
2016/0346593 A1 12/2016 Lagree
2016/0361602 A1 12/2016 Lagree
2017/0014664 A1 1/2017 Lagree
2017/0014672 A1 1/2017 Lagree
2017/0036057 A1 2/2017 Lagree
2017/0036061 A1 2/2017 Lagree
2017/0043210 A9 2/2017 Lagree
2017/0065846 A1 3/2017 Lagree
2017/0072252 A1 3/2017 Lagree
2017/0087397 A1 3/2017 Lagree

(56) References Cited

U.S. PATENT DOCUMENTS

| | | | |
|---|---|---|---|
| 2017/0100625 | A1 | 4/2017 | Lagree |
| 2017/0100629 | A1 | 4/2017 | Lagree |
| 2017/0106232 | A1 | 4/2017 | Lagree |
| 2017/0113091 | A1 | 4/2017 | Lagree |
| 2017/0120101 | A1 | 5/2017 | Lagree |
| 2017/0144013 | A1 | 5/2017 | Lagree |
| 2017/0157452 | A1 | 6/2017 | Lagree |
| 2017/0157458 | A1 | 6/2017 | Lagree |
| 2017/0165518 | A1 | 6/2017 | Lagree |
| 2017/0165555 | A1 | 6/2017 | Lagree |
| 2017/0189740 | A1 | 7/2017 | Lagree |
| 2017/0189741 | A1 | 7/2017 | Lagree |
| 2017/0209728 | A1 | 7/2017 | Lagree |
| 2017/0239526 | A1 | 8/2017 | Lagree |
| 2017/0246491 | A1 | 8/2017 | Lagree |
| 2017/0246499 | A1 | 8/2017 | Lagree |
| 2017/0296865 | A1 | 10/2017 | Lagree |
| 2020/0222741 | A1 | 7/2020 | Aronson |

* cited by examiner

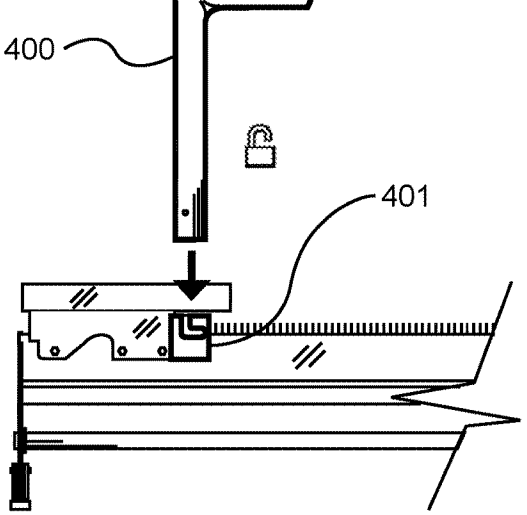
FIG. 9A
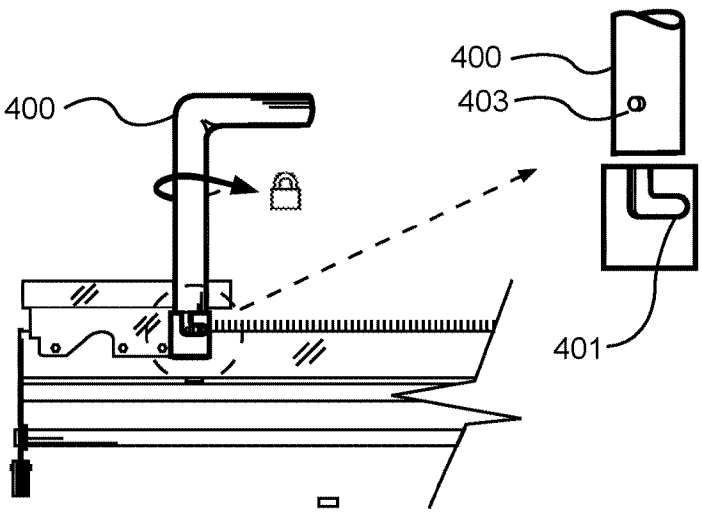
FIG. 9B
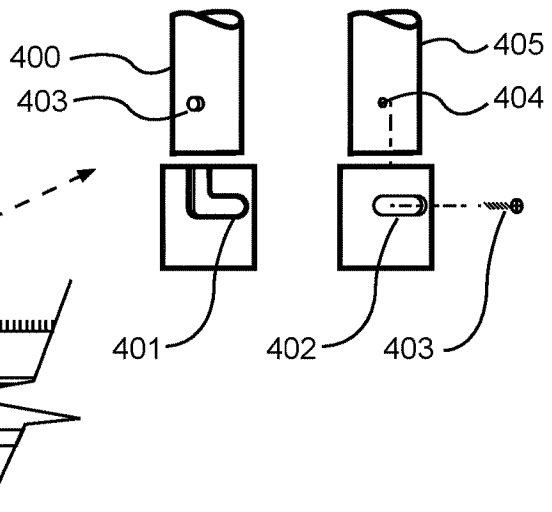
FIG. 9C
FIG. 9D
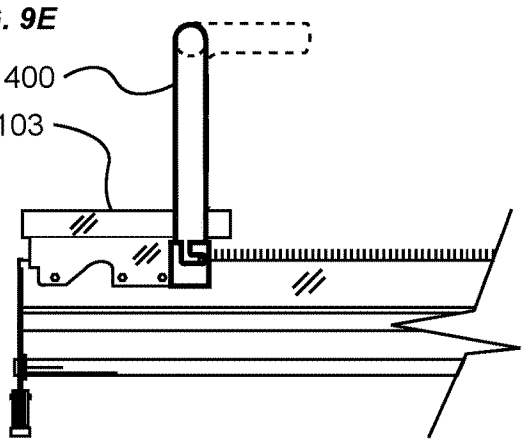
FIG. 9E
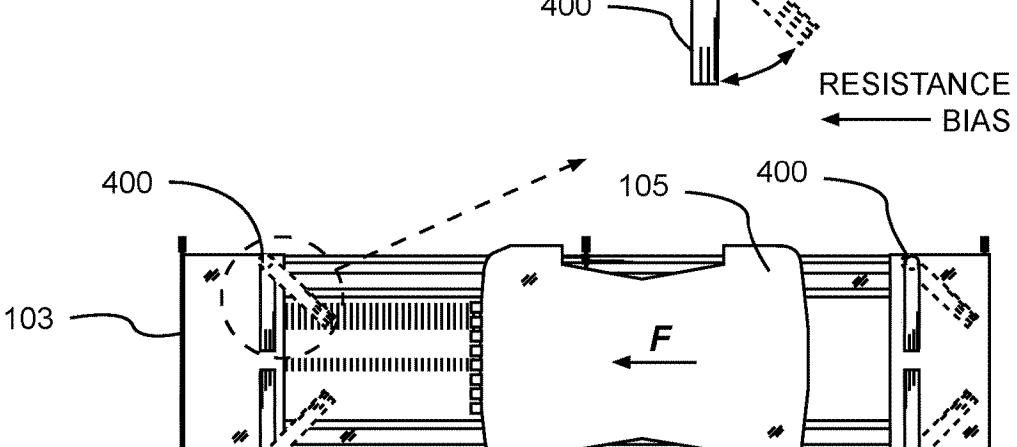
FIG. 9F

EXERCISE MACHINE WITH ADJUSTABLE HANDLES

CROSS REFERENCE TO RELATED APPLICATIONS

The present application is a continuation of U.S. application Ser. No. 17/507,032 filed on Oct. 21, 2021 which issues as U.S. Pat. No. 11,565,151 on Jan. 31, 2023, which is a continuation of U.S. application Ser. No. 16/698,151 filed on Nov. 27, 2019 now issued as U.S. Pat. No. 11,154,749, which is a continuation of U.S. application Ser. No. 15/789,304 filed on Oct. 20, 2017 now issued as U.S. Pat. No. 10,493,321, which claims priority to U.S. Provisional Application No. 62/410,823 filed Oct. 20, 2016. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to an exercise machine with adjustable handles that provide for multiple handle positions.

Related Art

Any discussion of the related art throughout the specification should in no way be considered as an admission that such related art is widely known or forms part of common general knowledge in the field.

Exercise machines have been in use for many years. One common exercise machine that has enjoyed increasing popularity is the reformer machine used to perform conventional Pilates exercises. A conventional reformer machine generally includes a frame, a track extending across the frame, and a carriage slidably connected to the track. The carriage is connected to one end of the frame by one or more bias members such as springs. U.S. Pat. No. 7,163,500 to Endelman discloses a conventional reformer machine suitable for use in performing conventional Pilates exercises.

Recent developments with reformer machines have increased the number and variety of exercises performable on the reformer machines. U.S. Pat. No. 8,641,585 to Sebastien Lagree discloses an exercise machine that improves upon conventional reformer machines.

SUMMARY

An example embodiment is directed to an exercise machine with adjustable handles. One embodiment of the exercise machine with adjustable handles includes a frame with one or more rails, a carriage movably positioned upon the rails, and a pair of adjustable handles positioned near an end of the frame. The adjustable handles each have a handle portion that is movably connected to a corresponding handle stanchion to pivot from a storage position to an extended position.

There has thus been outlined, rather broadly, some of the embodiments of the exercise machine with adjustable handles in order that the detailed description thereof may be better understood, and in order that the present contribution to the art may be better appreciated. There are additional embodiments of the exercise machine with adjustable handles that will be described hereinafter and that will form the subject matter of the claims appended hereto. In this respect, before explaining at least one embodiment of the exercise machine with adjustable handles in detail, it is to be understood that the exercise machine with adjustable handles is not limited in its application to the details of construction or to the arrangements of the components set forth in the following description or illustrated in the drawings. The exercise machine with adjustable handles is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 9A is an exemplary diagram showing a side view of a portion of an exercise machine with a removable handle removed from a machine.

FIG. 9B is an exemplary diagram showing a side view of a portion of an exercise machine with a removable handle attached to a machine.

FIG. 9C is an exemplary diagram showing a side view of pin and rotating slot engagement means of a removable handle.

FIG. 9D is an exemplary diagram showing a side view of a pin and rotating slot engagement means of a non-removable handle.

FIG. 9E is an exemplary diagram showing a side view of a portion of an exercise machine with a removable handle removably affixed to a machine.

FIG. 9F is an exemplary diagram showing a top view of a removable handle removably affixed to a machine.

DETAILED DESCRIPTION

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details.

The word "exemplary" is used herein to mean "serving as an example, instance, or illustration." Any embodiment described herein as "exemplary" is not necessarily to be construed as preferred or advantageous over other embodiments.

It should be noted that the words "front" and "back" are used throughout to identify by reference one distal end of an exercise machine, and the second distal end of an exercise machine. When a description of handles incorporated "front" or "back", these locations are interchangeable, and handles may be provided on the front and/or back of a machine without limitation.

FIGS. 1 through 6 illustrate a prior art exercise machine 100 that uses rotating handles near the opposing distal ends of the exercise machine 100. The various embodiments of the present invention shown in FIGS. 7A through 14C and variations thereof may be implemented upon the exercise machine 100 illustrated in FIGS. 1 through 6 by replacing one or more of the rotating handle assemblies 107, 108, 109, and 110 with the adjustable handles disclosed in FIGS. 7A through 14C. U.S. Pat. No. 8,641,585 to Lagree discloses an exemplary prior art exercise machine suitable for use with the various embodiments of the present invention and is hereby incorporated by reference herein.

Figure 1:
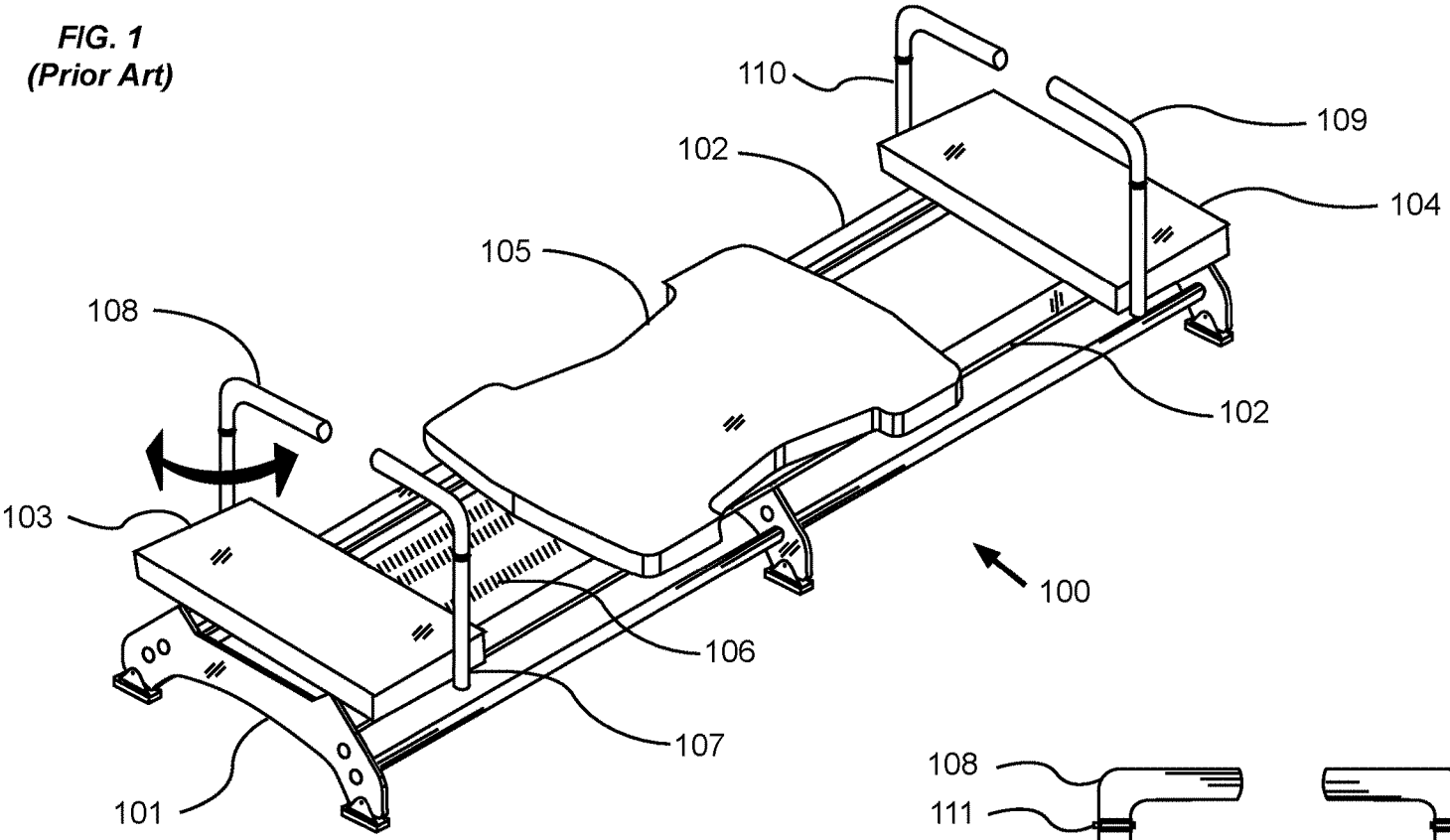
FIG. 1 (Prior Art)
FIG. 1 is an upper perspective view of a prior art exercise machine with rotating handles.
Figure 2:
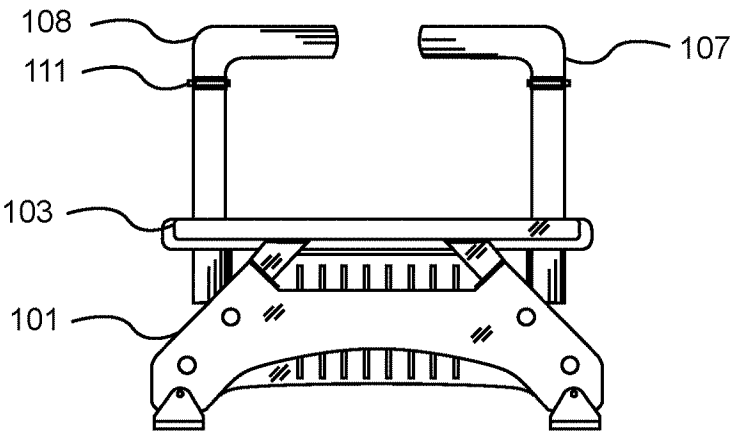
FIG. 2 (Prior Art)
FIG. 2 is a front view of a prior art exercise machine with rotating handles.

FIG. 1 is an exemplary diagram showing a perspective view of a prior art exercise machine with rotating handles. An exercise machine 100 is comprised of a frame having a base structure 101 that supports a pair of parallel rails 102 aligned with the longitudinal axis of the machine. The exercise machine 100 further preferably includes a front stationary platform 103, a back stationary platform 104, and carriage 105 movably positioned upon the parallel rails substantially the length of the machine between the front and back stationary platforms 103, 104. The carriage 105 may be comprised of a sliding platform that slides upon the one or more rails 102 using wheels or other movable structure. It can be appreciated that the exercise machine 100 may use a single rail instead of a pair of parallel rails 102 to movably support the carriage 105. One or more biasing members 106 (e.g. springs, elastic bands, electromagnetic resistance, etc.) are removably attached between the machine structure and the carriage 105, thereby exerting a resistance force upon the carriage 105 against which an exerciser must work during an exercise session. The machine further provides for a front left handle assembly 107, a front right handle assembly 108, a back left handle assembly 109, and a back right handle assembly 110. At least one pair of opposed left and right handles are rotatable about the vertical axis of the handle. FIG. 2 illustrates a front view of the prior art exercise machine showing a rotatable handle transition member 111.

Figure 3:
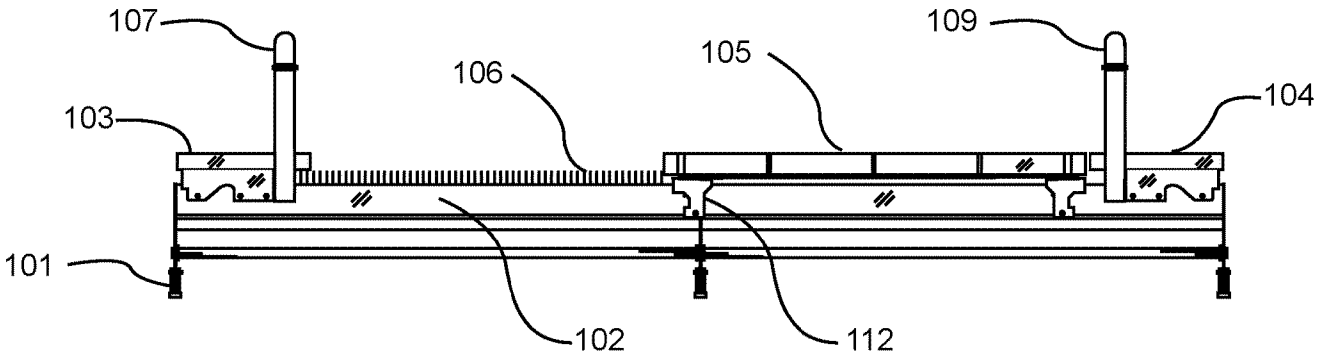
FIG. 3 (Prior Art)
FIG. 3 is a side view of a prior art exercise machine with rotating handles.

FIG. 3 illustrates a side view of the prior art exercise machine with repositionable handles. An exercise machine is comprised of a base structure 101 that supports a pair of parallel rails 102 aligned with the longitudinal axis of the machine, a front stationary platform 103, a back stationary platform 104, and a carriage 105 slidable upon the parallel rails substantially the length of the machine between the front and back stationary platforms 103, 104. The carriage 105 rolls upon the parallel rails on a plurality of wheel trolleys 112 affixed to the carriage. One or more biasing members 106 are removably attached between the machine structure and the carriage 105, thereby exerting a resistance force upon the carriage against which an exerciser must work during an exercise session. The machine further provides for a front left handle assembly 107 and a back left handle assembly 109.

Figure 4:
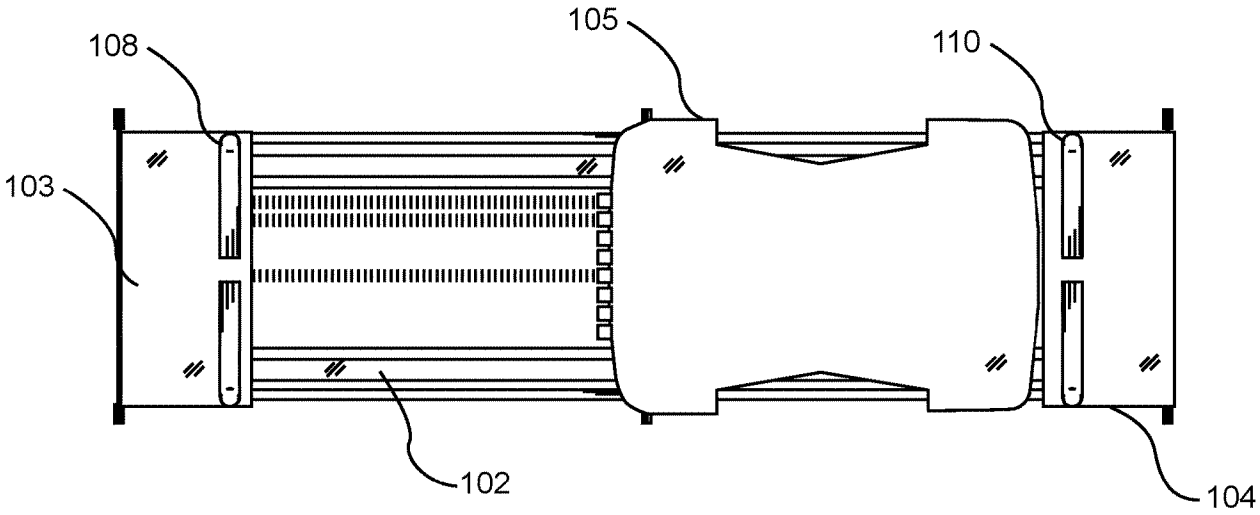
FIG. 4 (Prior Art)
FIG. 4 is a top view of a prior art exercise machine with rotating handles.

FIG. 4 is an exemplary diagram showing a top view of the prior art exercise machine with repositionable handles. An exercise machine is shown with a pair of parallel rails 102 aligned with the longitudinal axis of the machine, a front stationary platform 103, a back stationary platform 104, and a carriage 105 slidable upon the parallel rails. A front right handle assembly 108 and a back left handle assembly 110 are shown with the gripping portion of the handles aligned with an axis transverse to the longitudinal axis of the machine.

Figure 5:
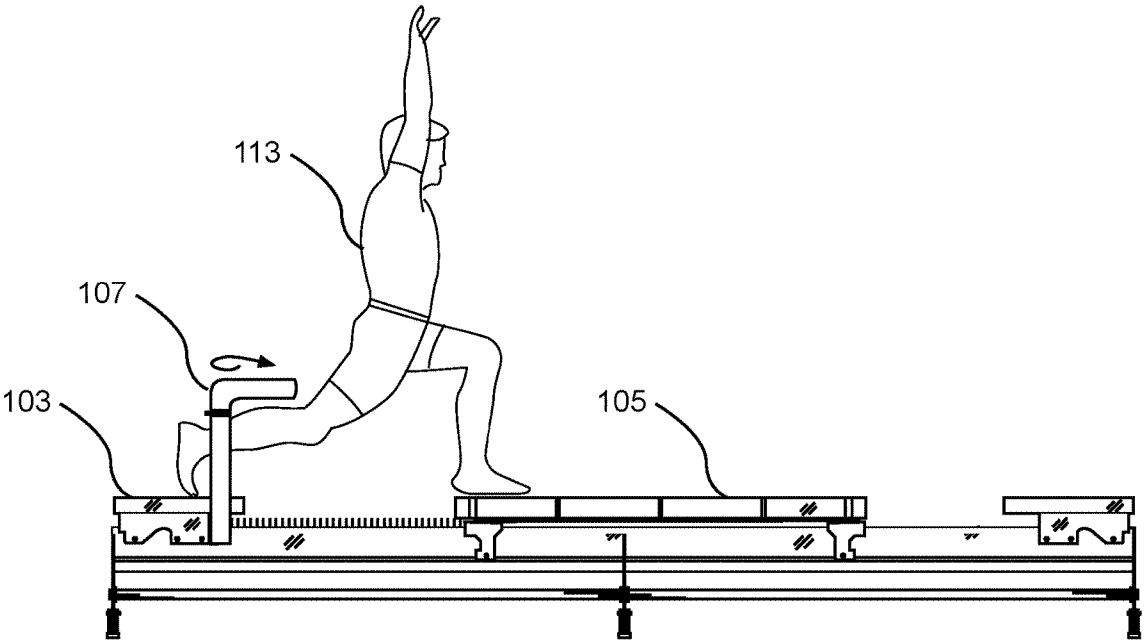
FIG. 5 (Prior Art)
FIG. 5 is a side view of a prior art exercise machine with the rotating handles positioned to avoid interfering with the exerciser during the performance of a specific type of exercise that does not involve usage of the handles.

FIG. 5 is an exemplary diagram showing a side view of the prior art exercise machine with repositionable handles not using handles. A standing exerciser 113 is positioned upon the machine with the right foot on the front stationary platform 103, and the left foot on the carriage 105. At least the front left handle assembly 107 has been rotated so as to not interfere with the exerciser's leg or foot while stepping on the front stationary platform. The central axis of the gripping portion of the handle has been aligned substantially with the longitudinal axis of the machine.

Figure 6:
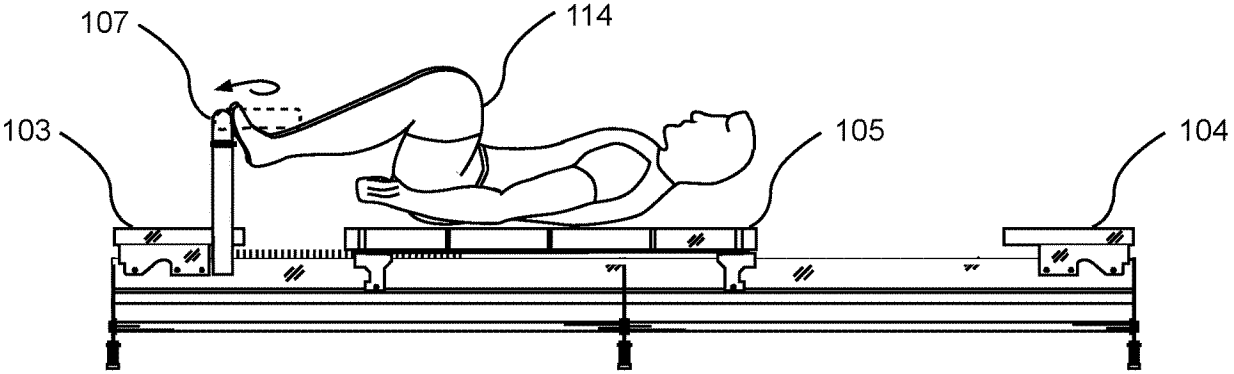
FIG. 6 (Prior Art)
FIG. 6 is a side view of a prior art exercise machine with the rotating handles positioned so the exerciser may engage the handles with their feet.

FIG. 6 is an exemplary diagram showing a side view of the prior art exercise machine with repositionable handles using handles. A supine exerciser 114 is positioned substantially upon the carriage 105 with the feet positioned upon one or more of the front rotatable handles 107. In order for the exerciser to move the carriage in a direction towards the back stationary platform 104 and against the resistance force created by the biasing members as previously discussed, the exerciser relies on pushing their feet against the front handles. The central axis of the gripping portion of the handle 107 has been rotated to align substantially transverse to the longitudinal axis of the machine.

It can be readily appreciated therefore, that some exercises will require the use of the rotatable handles to push or pull against during exercise, and other exercises will require the moving of the handles into a position that allows for unobstructed access to the exercise platforms.

FIGS. 7A through 7D illustrate an embodiment of the present invention that utilizes pivoting handles 201 that pivot about a non-vertical axis such as, but not limited to, a horizontal axis or an axis that is at an angle with respect to a vertical axis. The pivoting handles 201 shown in FIGS. 7A through 7E preferably pivot upwardly and downwardly along a vertical plane. The pivoting handles 201 pivot about a pivot joint. The handles 201 may be locked into various positions where they are not movable or unlocked to be adjusted into a desired position (e.g. storage position, intermediate position, extended position, raised position, and various other positions).

Figure 7C:
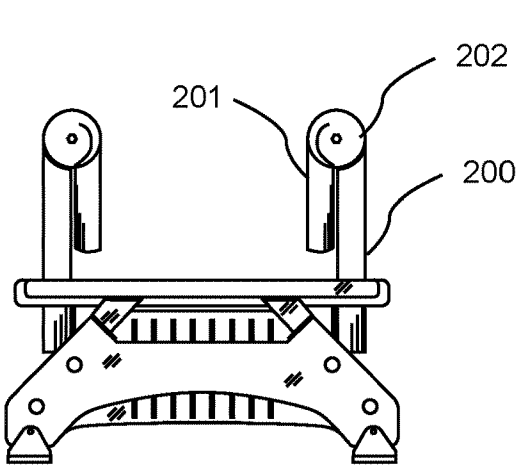
FIG. 7C is an exemplary diagram showing a front view of an exercise machine with repositioned articulating handles.
Figure 7B:
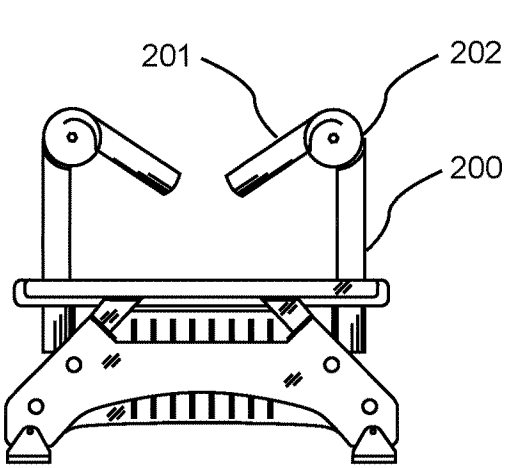
FIG. 7B is an exemplary diagram showing a front view of an exercise machine with repositioned articulating handles.
Figure 7A:
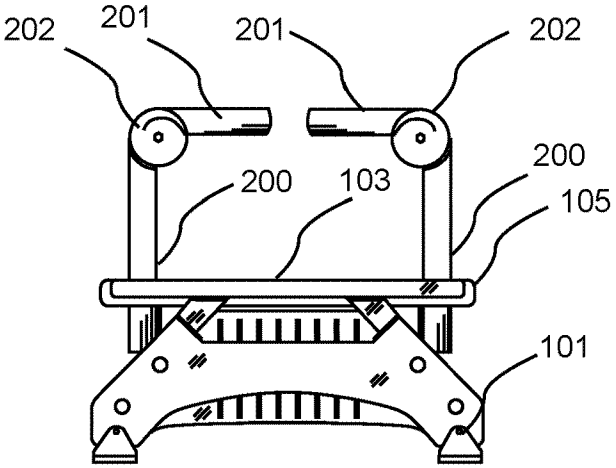
FIG. 7A is a front view of an exercise machine with articulating handles.

FIG. 7A is an exemplary diagram showing a front view of an exercise machine with articulating handles that are pivoted into an extended position that is substantially horizontal for engagement by the hands or feet of the exerciser. The handles 201 preferably pivot about an axis substantially aligned with the longitudinal axis of an exercise machine are shown pivotably attached to a handle stanchion 200 by connecting to a pivoting device 202 in a pivoting manner. The pivoting device 202 may be comprised of any device that allows for angular rotation of the handles 201 with their respective handle stanchion 200 such as, but not limited to, a locking hinge. The lower portion of the handle stanchion not shown is secured to the exercise machine structure by any well-known means including mechanical fasteners, adhesives, or welding. As shown in FIG. 7A, the central axis of the gripping portion of the handles 201 are preferably aligned with one another when in the extended position, transverse to the longitudinal axis of the machine, and locked in a substantially horizontal position for use by an exerciser.

FIG. 7B is an exemplary diagram showing a front view of an exercise machine with repositioned articulating handles in an intermediate position (e.g. 45 degrees with respect to a vertical axis) between the extended position in FIG. 7A and the storage position in FIG. 7C. In instances when an exerciser prefers to have the handles repositioned so as not to obscure use of the exercise platforms, an exerciser may change the pivotable angle of the handles. The handles 201 are shown in FIG. 7B as being pivoted about the pivoting device 202 medially downwardly intermediate position.

FIG. 7C is an exemplary diagram showing a front view of an exercise machine with repositioned articulating handles in a storage position. Continuing with the immediately preceding description, an exerciser continues to pivot the handles 201 medially downwardly about the pivoting device 202 until the handles are substantially proximate to the handle stanchion 200 in the storage position. The handle position just described would preferably define the stowed position of the handles 201 so the handles 201 do not interfere with exercises performed by the exerciser that do not involve the usage of the handles 201. When the handles 201 are in the storage position, the handles 201 are preferably substantially parallel to and adjacent to the corresponding handle stanchions 201 extending downwardly as illustrated in FIG. 7C. While FIG. 7C shows the handles 201 extending downwardly in a vertical manner, the handles 201 may extend downwardly at an angle with respect to a vertical axis. Furthermore, while FIG. 7C shows the handles 201 extending parallel to and adjacent the interior portion of the handle stanchions 201, the handles 201 may be pivoted into a position that extends downwardly with respect to an exterior portion of the handle stanchions 201 (not shown).

Figure 7E:
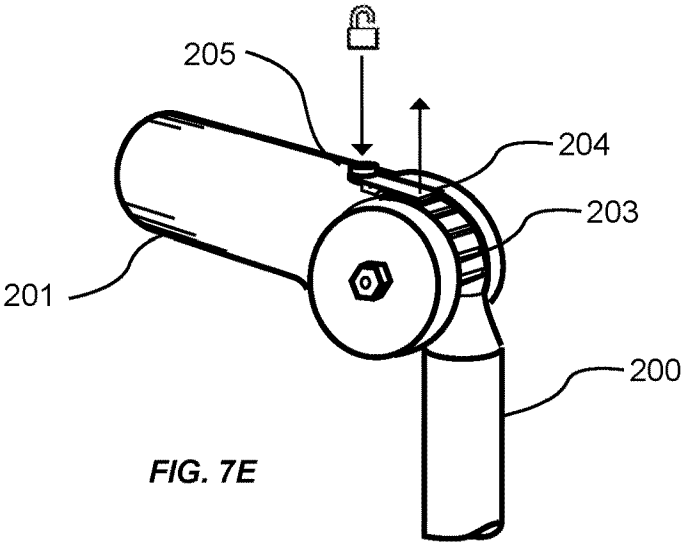
FIG. 7E is an exemplary diagram showing a perspective view of one method of locking and unlocking articulating handles.
Figure 7D:
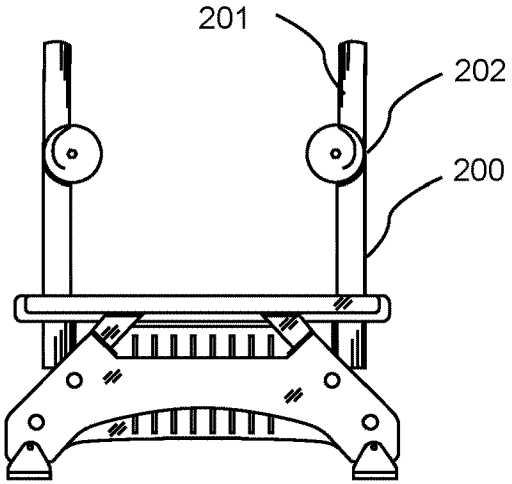
FIG. 7D is an exemplary diagram showing a front view of an exercise machine with repositioned articulating handles.

FIG. 7D is an exemplary diagram showing a front view of an exercise machine with repositioned articulating handles in an upwardly raised position. It may sometimes be preferred by an exerciser to have hand-holding support at an elevation higher than the typical hand-gripping handles of the machine. In such instances, an exerciser may rotate one or more handles 201 about the pivoting device 202 in an upward and outward direction as shown in FIG. 7D. An exerciser may lock the handles in the raised elevation position during exercise, or return the one or more handles to one of a plurality of previously described positions about the pivoting device. When the handles 201 are in the raised position, the handles 201 may extend upwardly in a vertical manner or at an upward angle.

FIG. 7E is an exemplary diagram showing a perspective view of an embodiment of the pivoting device 202 for the locking and unlocking articulating handles 201. It should be noted that the method and structure of locking a rotating handle in one of a plurality of positions is not meant to be limiting as those skilled in the art will appreciate that there exists a large body of work illustrating methods of retarding the rotational relationship of one member to an attached member, including friction, ratchets and pawls, retractable pins and holes, pull pins, and detents. Any well-known system of retarding the rotation of the handle 201 relative to the stanchion 200 may be used without departing from the present invention. The pivoting device 202 may be comprised of various pivoting structures capable of selectively pivoting the corresponding handle 201 into a desired locked position. When the handle 201 is in the desired locked position (e.g. raised position, extended position, intermediate position, storage position), the handle 201 is secured and locked into the desired locked position so that the handle 201 does not move when an exerciser engages the handle 201 for support during the performance of an exercise.

In an embodiment shown in FIG. 7E, the pivoting device 202 may include a fixed ratchet wheel 203 is shown that may be attached to or integral with the handle stanchion 200, the ratchet wheel providing for a plurality of intentionally positioned slots into which a pawl 204 will engage when the handle is in a preferred rotational position. An exerciser may disengage the pawl by depressing a pawl release 205 against the surface of the handle, thereby raising the engaging end of the pawl from the ratchet wheel. After disengagement, an exerciser may rotate the handle 201 about the pivoting device 202 to any desired achievable rotational angle. The exerciser would then release the pawl release to lock the handle in the preferred position.

The exercise machine 100 includes a frame having a first end, a second end opposite of the first end, a first side, a second side opposite of the first side, and a longitudinal axis extending between the first end and the second end of the frame as illustrated in FIGS. 1, 3, and 4 of the drawings. The exercise machine preferably includes a first stationary platform attached to the frame and positioned near the first end of the frame as shown in FIGS. 1 and 4. The exercise machine further preferably includes a second stationary platform attached to the frame and positioned near the second end of the frame as shown in FIGS. 1 and 4.

The exercise machine further includes a carriage movably positioned upon the frame. The carriage is adapted to be movable in a reciprocating manner along at least a portion of an axis extending between the first end and the second end. One or more resistance members (e.g. springs) are connected to the carriage to provide a resistance force to the carriage during the performance of an exercise.

The exercise machine further includes a first handle device attached to the frame as shown in FIGS. 7A through 7D of the drawings. The first handle device is positioned near the first end of the frame and the first side of the frame. The first handle device is comprised of a first handle stanchion extending upwardly from the frame, a first pivot device attached to the first handle stanchion, and a first handle pivotally connected to the first pivot device. The first handle pivots about a first axis where the first axis is preferably horizontal but may be at various other angles. The first handle is pivotable from a storage position to an extended position as shown in FIGS. 7A and 7C.

The exercise machine further includes a second handle device attached to the frame opposite of the first handle device as shown in FIGS. 7A through 7D of the drawings. The second handle device is positioned near the second end of the frame and the second side of the frame. The second handle device is comprised of a second handle stanchion extending upwardly from the frame, a second pivot device attached to the second handle stanchion, and a second handle pivotally connected to the second pivot device. The second handle pivots about a second axis where the second axis is preferably horizontal but may be at various other angles. The second handle is pivotable from a storage position to an extended position as shown in FIGS. 7A and 7C. The first handle device and the second handle device form a first pair of handle devices that are positioned near the first end of the exercise machine. A second pair of handle devices of similar structure may be positioned near the second end of the exercise machine.

The first axis and the second axis are preferably parallel to one another. The first axis and the second axis are preferably parallel to the longitudinal axis of the frame of the exercise machine.

The first pivot device and the second pivot device are each preferably attached to an upper end of the first handle stanchion and the second handle stanchion respectively as shown in FIGS. 7A through 7E. The first handle and the second handle are each preferably comprised of a straight structure and may include a gripping for grasping by an exerciser. The first handle stanchion and the second handle stanchion are preferably parallel to one another and may further be vertical.

The first handle is preferably concentrically aligned with and directed towards the second handle when the handles are in the extended position as illustrated in FIG. 7A of the drawings. The first handle is preferably substantially parallel to the first handle stanchion when in the storage position and the second handle is also preferably substantially parallel to the second handle stanchion when in the storage position as illustrated in FIG. 7C of the drawings. The first handle is preferably positioned adjacent to the first handle stanchion when in the storage position and the second handle is preferably positioned adjacent to the second handle stanchion when in the storage position as further shown in FIG. 7C of the drawings.

The first handle and the second handle are each preferably pivotable to an intermediate position between the storage position and the extended position as shown in FIG. 7B of the drawings. The first handle and the second handle are each preferably pivotable to a raised position that extends upwardly above the extended position as illustrated in FIG. 7D of the drawings.

The first pivot device and the second pivot device each have a locked state that prevents movement of the handles and an unlocked state that allows for movement of the handles to different positions. The first pivot device and the second pivot device may each be comprised of a ratchet device or other device capable of supporting the handles in various locked positions.

The first handle and the second handle each preferably extend horizontally when in the extended position as shown in FIG. 7A of the drawings. The first handle and the second handle each extend preferably inwardly towards one another when in the extended position as shown in FIG. 7A of the drawings. The first handle and the second handle each preferably extend downwardly when in the storage position as shown in FIG. 7A of the drawings. The first handle preferably extends in a direction transverse with respect to the longitudinal axis when in the extended position and the second handle preferably extends in a direction transverse with respect to the longitudinal axis when in the extended position.

Figure 8A:
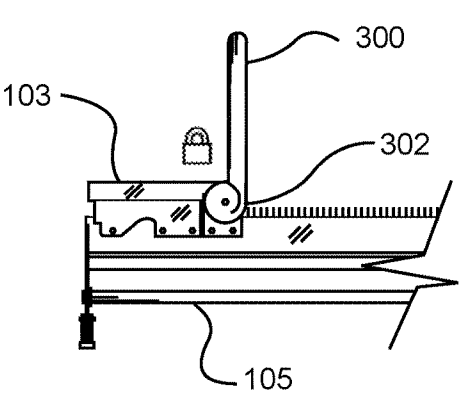
FIG. 8A is an exemplary diagram showing a side view of an exercise machine with articulating handles.

FIG. 8A is an exemplary diagram showing a side view of an exercise machine with articulating handles. More specifically, a pair of opposed handles 300, 301 are shown with a fixed length pivot arms, and fixed length gripping handle surfaces. In the drawing, the left handle 300 is shown substantially perpendicular to the horizontal surface of the front stationary platform 103, the handle having been locked about the pivoting device 202 for use by an exerciser.

Figure 8B:
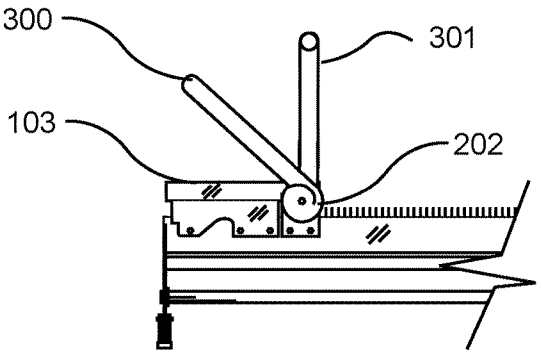
FIG. 8B is an exemplary diagram showing a side view of an exercise machine with a repositioned articulating handle.

FIG. 8B is an exemplary diagram showing a side view of an exercise machine with a repositioned articulating handle. More specifically, a left pivotable handle 300 is shown pivoted about the pivoting device 202 at an acute angle relative to the front stationary platform 103, having been unlocked for preferably stowing to allow use of the exercise platform. Further, the drawing shows a second, opposed front right handle 301 remaining in the vertical locked position. It may be preferable to keep one handle in a vertical position, and one handle in a stowed position. The handles may be pivoted independently.

Figure 8C:
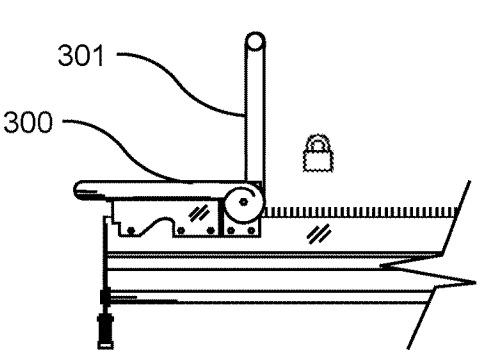
FIG. 8C an exemplary diagram showing a side view of an exercise machine with a repositioned articulating handle.

FIG. 8C an exemplary diagram showing a side view of an exercise machine with a repositioned articulating handle. In the drawing, the front left handle 300 is shown fully stowed with the top surface of the now stowed handle being substantially coplanar with the top surface of the front stationary platform previously described. It is preferable to align the top surfaces of the stowed handle and stationary platform, thereby eliminating substantial surface variations that otherwise may become a safety issue for the exercisers.

Figure 8D:
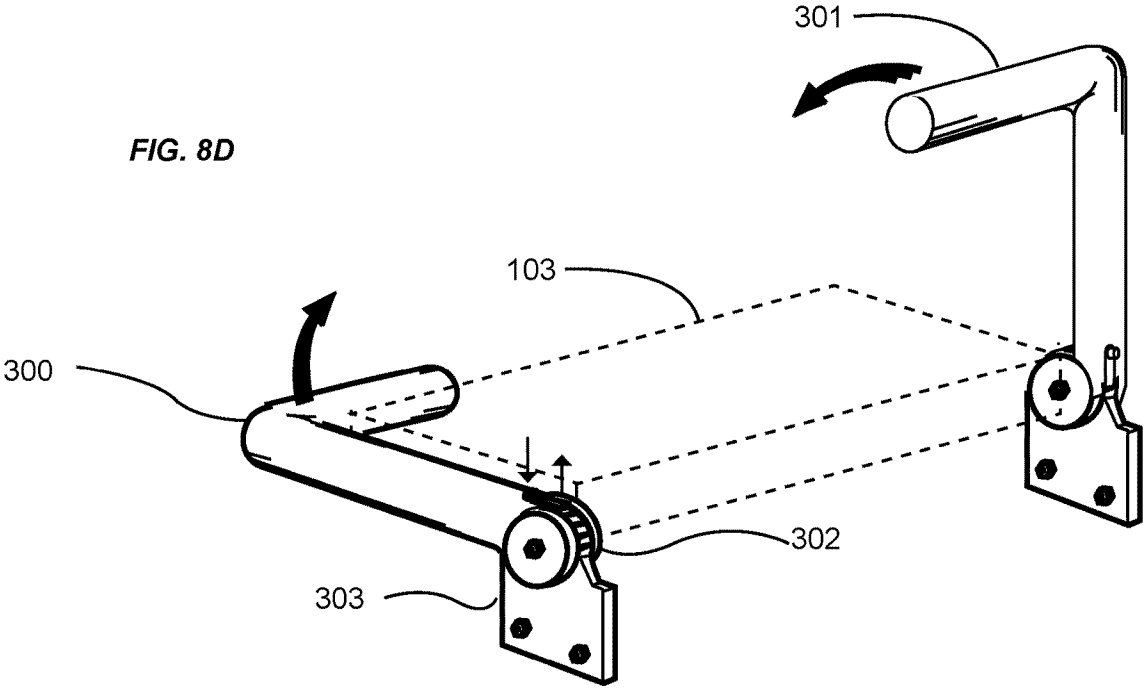
FIG. 8D an exemplary diagram showing a perspective view of an exercise machine with a repositioned articulating handle.

FIG. 8D an exemplary diagram showing a perspective view of an exercise machine with a repositioned articulating handle. As can readily be seen, the upper surface of the stowed left front handle 300 is substantially coplanar with the stationary platform, illustrated in the drawing by a dotted outline so as to not obscure features of the opposed right front handle 301. The handles just described pivot about the axis of their respective pivoting devices 302, the pivoting devices being securely attached to the machine structure by means of a typical mounting member 303. The pivot locking system shown in the present drawing is, for illustrative purposes, similar to the fixed ratchet and pawl locking system previously described FIG. 7E.

FIG. 9A is an exemplary diagram showing a side view of a portion of an exercise machine with a removable handle removed from a machine. Another variation of rotatable handles may be removable. In the drawing, a removable handle 400 is shown unlocked and removed from a removable handle socket 401, the socket being securely attached to the machine structure.

FIG. 9B is an exemplary diagram showing a side view of a portion of an exercise machine with a removable handle attached to a machine. A removable handle is removably attached to the machine by inserting the handle 400 into the removable handle socket 401.

FIG. 9C is an exemplary diagram showing a side view of pin and rotating slot engagement means of a removable handle. The retaining pin 403 of the handle 400 is aligned with the retaining pin slot of the socket 401. After vertically inserting the handle into the socket, the handle is rotated so that the retaining pin follows the horizontal retaining pin slot.

FIG. 9D is an exemplary diagram showing a side view of a pin and rotating slot engagement means of a non-removable handle. In some instances, it may be preferred to not have the handle removable. A non-removable handle 405 is inserted into a non-removable handle socket after which a retaining pin 403 is inserted through the non-removable handle socket 402 and into the retaining pin hole 404 on the handle. Those skilled in the art will appreciate that many fastener types may be used for the retaining pin including self-tapping screws, rivets, or press-fit pins. The type of retaining pin is not meant to be limiting.

FIG. 9E is an exemplary diagram showing a side view of a portion of an exercise machine with a removable handle removably affixed to a machine. More specifically, the handle 400 is inserted into the socket as previously discussed, the insertion accomplished with the central axis of the handle is substantially aligned with the longitudinal axis of the machine. Thereafter, the handle is secured into the socket by rotating the handle, and coincidentally the retaining pin so that the retaining pin follows the horizontal slot in the socket until fully engaged and locked into place.

FIG. 9F is an exemplary diagram showing a top view of removable handle removably affixed to a machine. In the drawing, it can be readily seen that the left and right handles rotate in opposite directions. For instance, the right handles 400 rotate clockwise to lock. Since the biasing force F on the carriage 105 is in a direction towards the front stationary platform 103 as indicated by the arrow, it is desirable that the handles are lockable in a position wherein the central axis of the gripping handle is transverse to the longitudinal axis of the machine so that they will not unlock when an exerciser pushes or pulls on the handles in opposition to the biasing force.

Figure 10A:
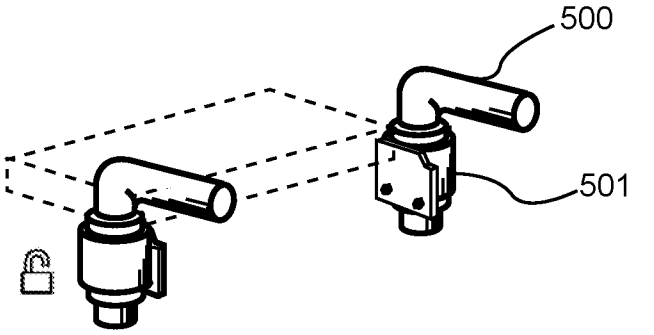
FIG. 10A is an exemplary diagram showing a perspective view of a portion of an exercise machine with height-adjustable rotating handles.

FIG. 10A is an exemplary diagram showing a perspective view of a portion of an exercise machine with a height-adjustable rotating handles. In the variation, extendable rotating handles 500 are shown in the stowed, retracted position within the handle support member 501.

Figure 10B:
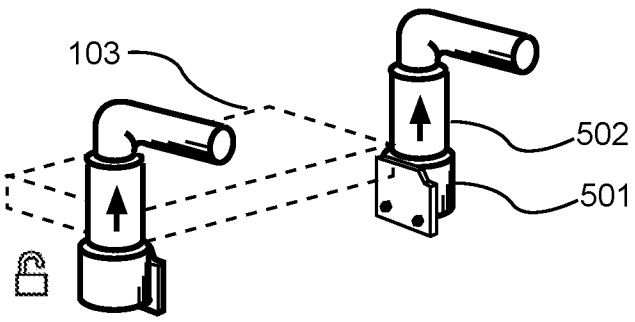
FIG. 10B is an exemplary diagram showing a perspective view of a portion of an exercise machine with height-adjustable rotating handles.

FIG. 10B is an exemplary diagram showing a perspective view of a portion of an exercise machine with a height-adjustable rotating handles. An exerciser engages the handles by pulling upward, thereby withdrawing the extension collet member 502 from the handle support member 501 to the preferred elevation over the stationary platform represented by the dotted line 103.

Figure 10C:
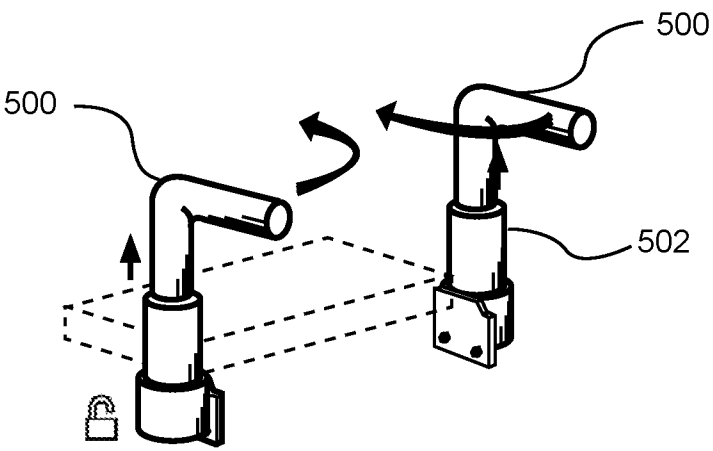
FIG. 10C is an exemplary diagram showing a perspective view of a portion of an exercise machine with height-adjustable rotating handles.

FIG. 10C is an exemplary diagram showing a perspective view of a portion of an exercise machine with a height-adjustable rotating handles. Subsequent to raising the handles to the preferred extended length, an exerciser would lock the handles in place by counter-rotating the two handles 500 towards one another as shown. The rotation of the handles, once extended, tighten an internal collet not shown, thereby locking the height and position of the handles in a preferred position.

Figure 10D:
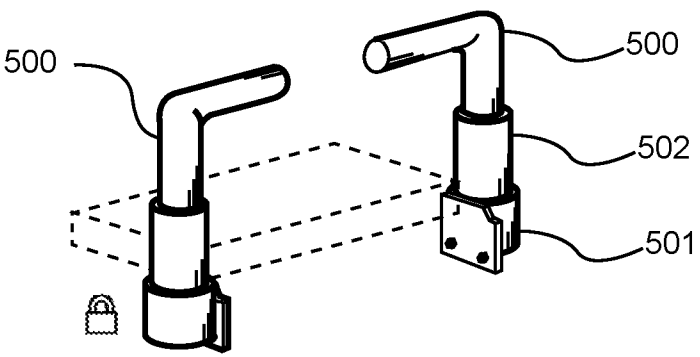
FIG. 10D is an exemplary diagram showing a perspective view of a portion of an exercise machine with height-adjustable rotating handles.

FIG. 10D is an exemplary diagram showing a perspective view of a portion of an exercise machine with height-adjustable rotating handles. When the central axis of the gripping surfaces of the opposed handles 500 are aligned as shown, the internal collets are tightened to retain the extension collet member 502 as the preferred height, and the handles rotatably locked relative to the handle support member 501.

Figure 11A:
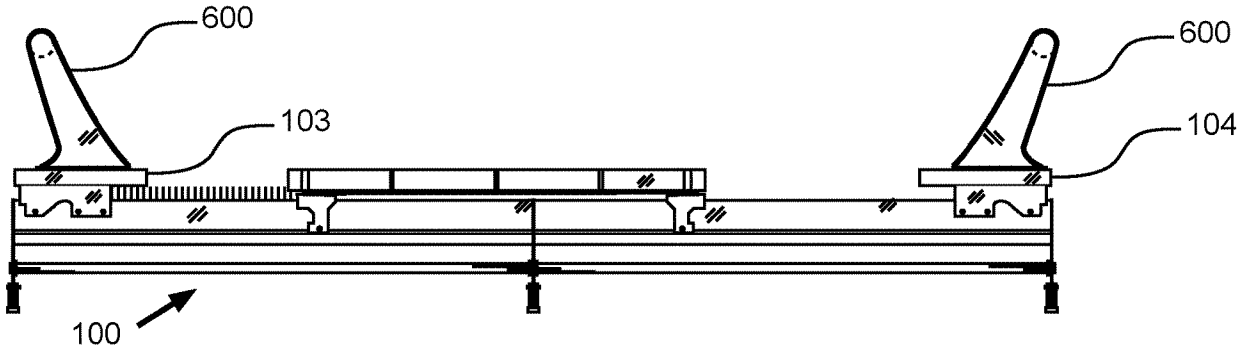
FIG. 11A is an exemplary diagram showing a side view of an exercise machine with rotatable handles.

FIG. 11A is an exemplary diagram showing a side view of an exercise machine 100 with rotatable handles. More specifically, at least one pair of rotatable handles 600 are provided integral or proximate to the front stationary platform 103 or back stationary platform 104, the handles being of a fixed dimension above the top surface of the exercise platform.

Figure 11B:
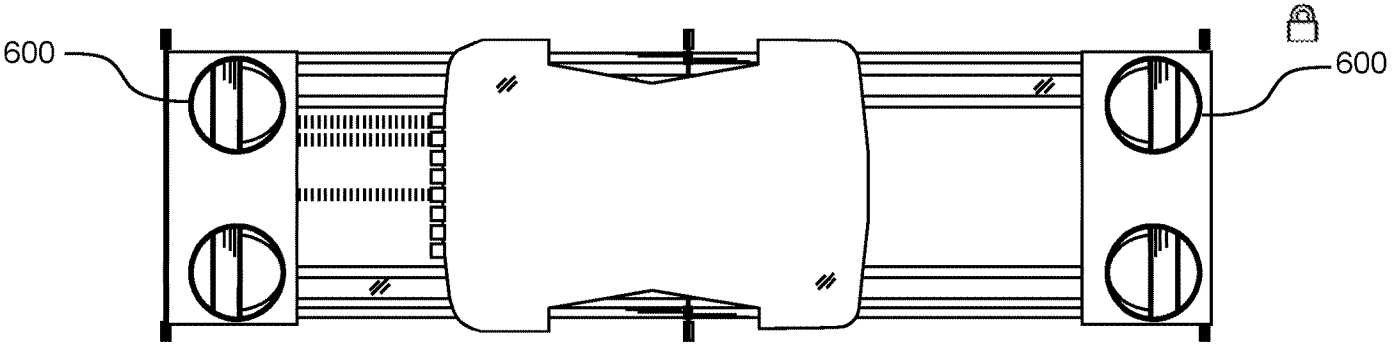
FIG. 11B is an exemplary diagram showing a top view of an exercise machine with rotatable handles.

FIG. 11B is an exemplary diagram showing a top view of an exercise machine with rotatable handles. As can readily be seen, the rotatable handles 600 provide for a substantially circular base to allow for circular rotation about the venter of the base circle. The central axis of the gripping surfaces of the handles is substantially aligned with the opposed handle indicating that the handles are in the position for use by an exerciser.

Figure 11C:
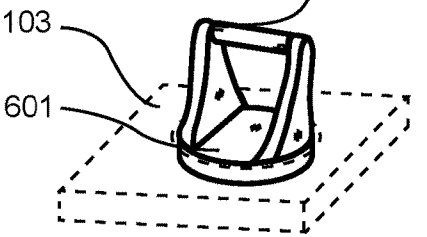
FIG. 11C is an exemplary diagram showing a perspective view of a rotatable handle.

FIG. 11C is an exemplary diagram showing a perspective view of a rotatable handle. As a means of ensuring the flattest exercise platform surface unobstructed by, it can be seen that the rotatable handle 600 is recessed into the exercise platform 103 indicated by the dotted line such that the top surface of the circular base 601 and top surface of the platform 103 are substantially coplanar.

Figure 11D:
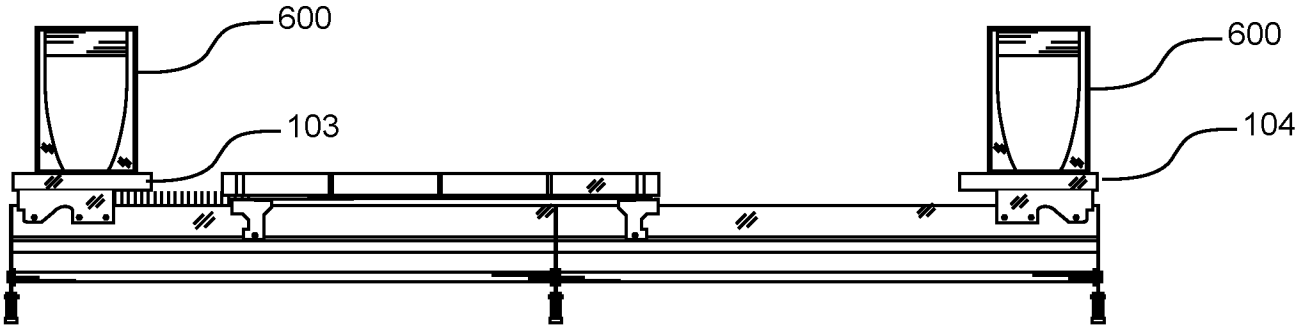
FIG. 11D is an exemplary diagram showing a side view of an exercise machine with rotated handles.

FIG. 11D is an exemplary diagram showing a side view of an exercise machine with rotated handles. In the drawing, it can be readily seen that the central axis of the gripping surfaces of the handles 600 are substantially aligned with the longitudinal axis of the machine. Although the handles may still be used by an exerciser in the stowed position just described, the handles thus rotated provide for a substantially less obstructed access to the front and back stationary platforms 103, 104.

Figure 11E:
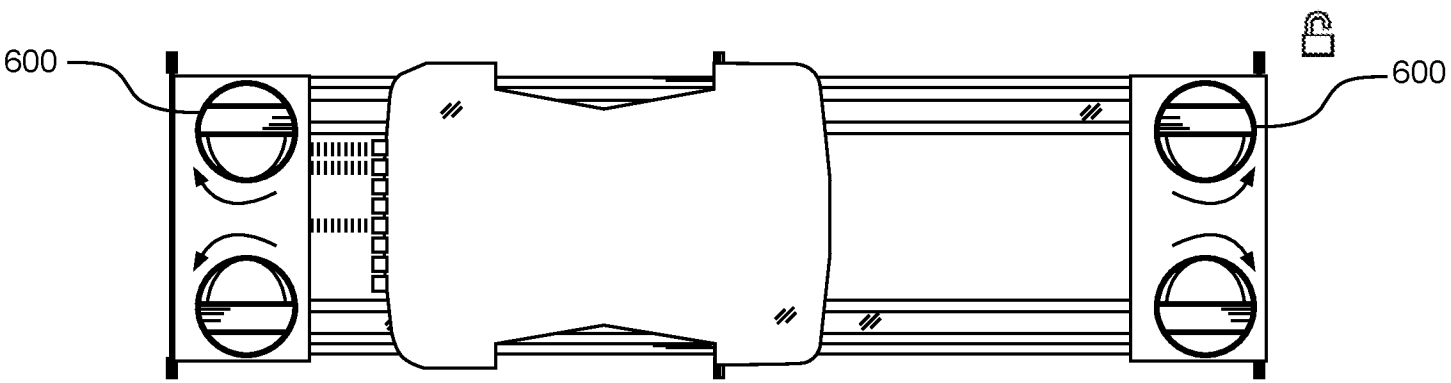
FIG. 11E is an exemplary diagram showing a top view of an exercise machine with rotated handles.

FIG. 11E is an exemplary diagram showing a top view of an exercise machine with rotated handles. As just described, the gripping surface of the handles 600 is shown aligned with the longitudinal axis of the machine. It can be seen that the gripping surfaces are preferably off centered from the center of the circular handle base. Those skilled in the art will appreciate that the configuration just described provides for a cam-like rotation of the handle gripping surface so that the gripping surfaces of the opposed handles increase as the handles are rotated from the in-use to stowed position, thereby increasing the usable exercise platform area between the handles.

Figure 12A:
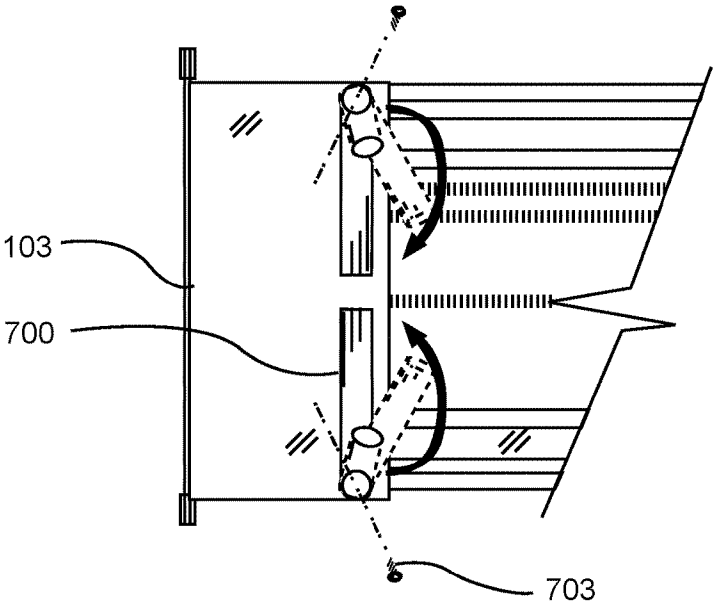
FIG. 12A is an exemplary diagram showing a top view of an exercise machine with swing-away handles and posts.

FIG. 12A is an exemplary diagram showing a top view of an exercise machine with swing-away handles and posts. A pair of opposed skewed rotational axis handles 700 are shown proximate to a front stationary platform 103 of an exercise machine. In the drawing, an axle fastener 703 is inserted between the upper and lower parts of each handle, thereby providing a rotational axis about which the upper handle pivots relative to the lower handle. It can be readily seen that the axis of the fasteners are not aligned with either the transverse or longitudinal axes of the machine.

Figure 12C:
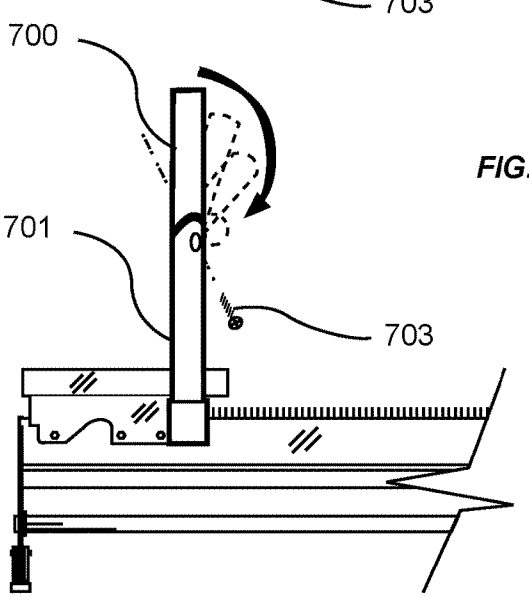
FIG. 12C is an exemplary diagram showing a side view of an exercise machine with swing-away handles and posts.
Figure 12B:
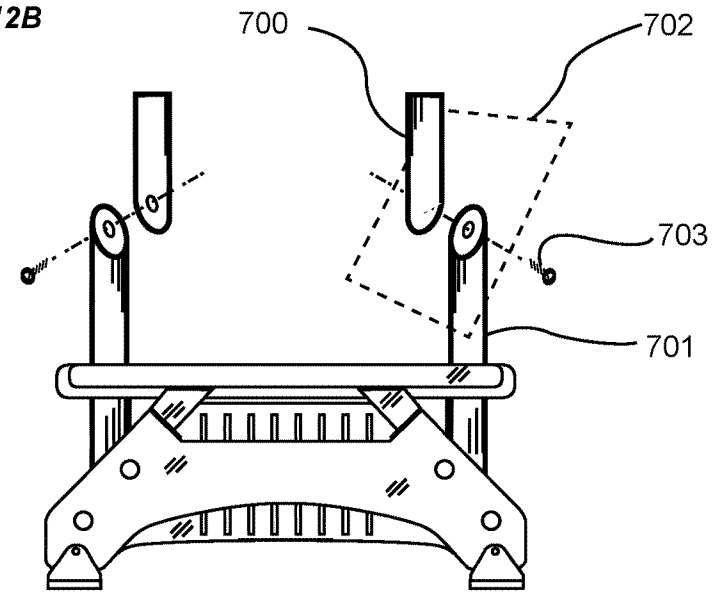
FIG. 12B is an exemplary diagram showing a front view of an exercise machine with swing-away handles and posts.

FIG. 12B is an exemplary diagram showing a front view of an exercise machine with swing-away handles and posts. A skewed rotational axis handle 700 is shown with the central axis of the gripping surface substantially vertical, and the lower end of the handle with a diagonal surface substantially aligned with the skewed rotational plane 702. Further, a skewed axis stanchion 701 is shown with an upper surface skewed to substantially align with the skewed rotational plane 702. An axel fastener 703 is shown with a central axis substantially normal to the skewed rotational plane 702, passing through the skewed axis stanchion and into the skewed rotational axis handle 700.

FIG. 12C is an exemplary diagram showing a side view of an exercise machine with swing-away handles and posts. In practice, an exerciser will rotate the handles 700 into a use position by gripping the handle surface, and rotating the handles about the axis of the axle fastener. The handle following the preferred rotational arc about the fastener axis.

Figure 13A:
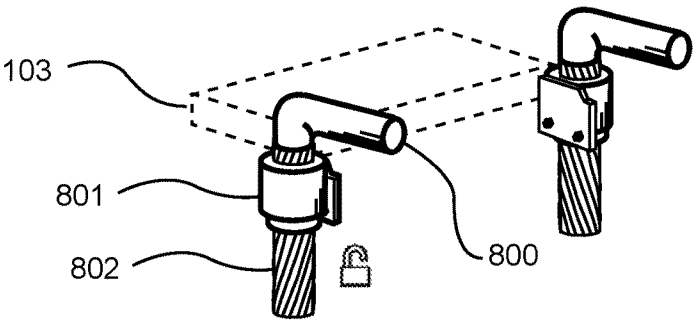
FIG. 13A is an exemplary diagram showing a perspective view of extending rotatable handles with helical bolts.

FIG. 13A is an exemplary diagram showing a perspective view of extending rotatable handles with helical bolts. Those skilled in the art appreciate that steep angle helical threads are substantially long, and provide for significant longitudinal travel of a bolt relative to the number of degrees of bolt rotation.

Therefore, it may be preferred that extendable rotatable handles 800 proximate to a front stationary platform 103 of an exercise machine can be quickly extended from a stowed position to a use position by means of helical threads 802 provided on the lower surface of the handle. Further, a helical thread mounting member 801, being affixed to the structure of an exercise machine not shown, provides for an inner surface containing female helical threads that mate with the helical threads 802 of the handles 800.

Figure 13B:
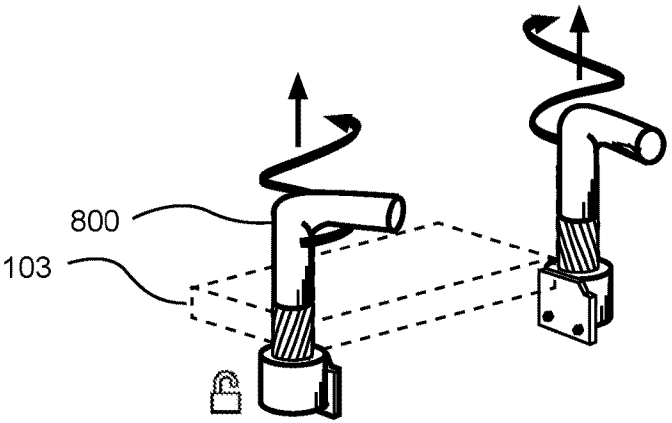
FIG. 13B is an exemplary diagram showing a perspective view of extending rotating handles with helical bolts.

FIG. 13B is an exemplary diagram showing a perspective view of extending rotating handles with helical bolts. In the drawing, extendable rotatable handles 800 are being counter rotated by pulling the handles rotationally upward to a preferred user height above the upper surface of an exercise platform 103. In some instances, the height may be increased by rotating the handles one additional rotation. However, it is preferred that the handles rotate minimally to achieve the preferred height extension.

Figure 13C:
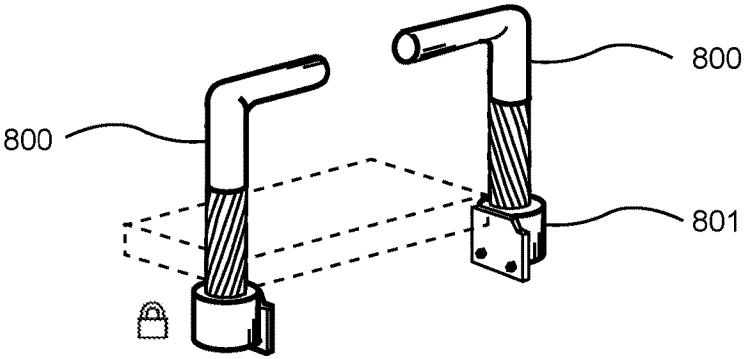
FIG. 13C is an exemplary diagram showing a perspective view of rotated handles with helical bolts extended into a use position.

FIG. 13C is an exemplary diagram showing a perspective view of rotated handles with helical bolts extended into a use position. In the fully extended position ready for use by an exerciser, central axis of the gripping surface of the extendable rotatable handles are aligned and substantially perpendicular to the longitudinal axis of the exercise machine not shown.

Various well known means may be used to stop the upward rotation to position the handles at the desired height and orientation including mechanical stops such as shaft collar fixed against a flatted section of the lower portion of the helical threads by means of set screws. The handles may be retained in the preferred position by friction between the helical threads of the bolt and mounting member.

Figure 14C:
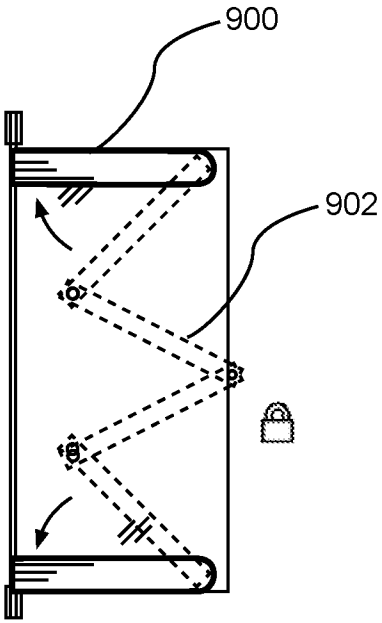
FIG. 14C is an exemplary diagram showing a top view of a portion of an exercise machine with handles and actuation linkage in a rotated and stowed position.
Figure 14B:
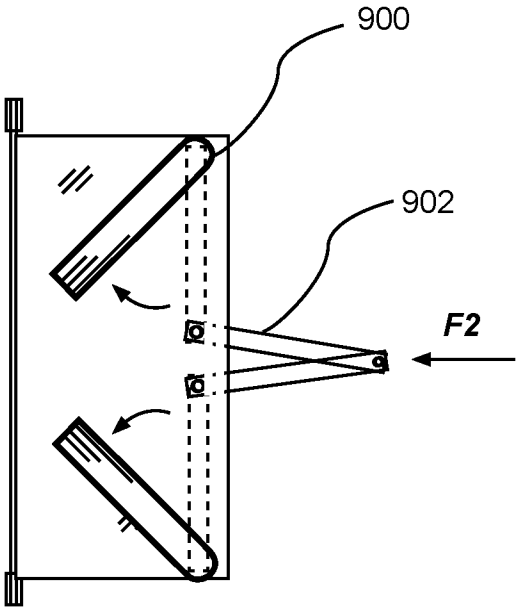
FIG. 14B is an exemplary diagram showing a top view of a portion of an exercise machine with rotatable handles and linkage being actuated.
Figure 14A:
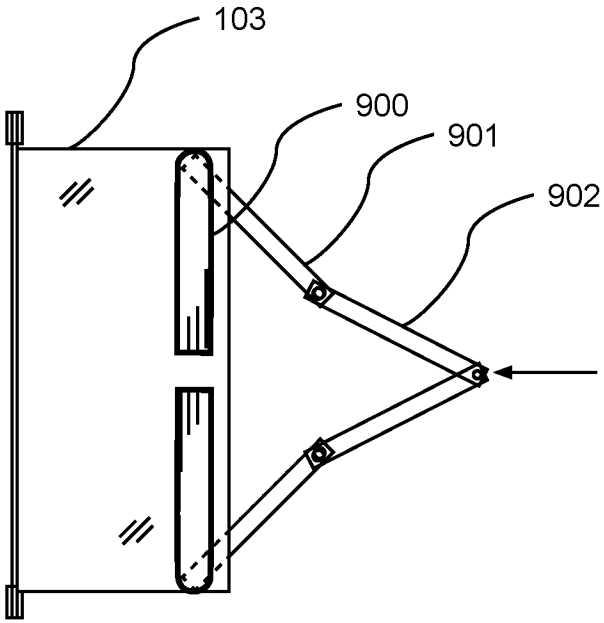
FIG. 14A is an exemplary diagram showing a top view of a portion of an exercise machine with rotatable handles and actuation linkage.

FIG. 14A is an exemplary diagram showing a top view of a portion of an exercise machine with rotatable handles and actuation linkage. Rotating a member about a shaft connected to mechanical linkage is well known, one example of which is a simple vehicle steering arm. Linkable actuators may be fast acting, and provide positive mechanical stops at the opposed ends of preferred travel.

In the present variation, handles 900 are shown in the use position with the central axis of the gripping surfaces substantially aligned transverse to the longitudinal axis of an exercise machine not shown. For positional reference, a front stationary platform 103 as previously described is shown.

The handles are affixed to vertical stanchions which act as rotatable shafts. A handle idler arm 901 is affixed to the lower end of the stanchion at an angle relative to the handle so as to allow for a preferred ninety degree swing of the rotatable handle, the idler arm being preferably positioned on the underside of the exercise platforms so that none of the linkage is exposed to the exercisers.

A link 902 is pivotably attached to substantially the proximate end of the idler arm, the link being pivotably attached to an actuator not shown. It should be noted that there exists a large body of art relating to linkage actuators, and a large number of different types of well-known manual and powered actuators may be used without limitation.

FIG. 14B is an exemplary diagram showing a top view of a portion of an exercise machine with rotatable handles and linkage being actuated. During actuation, an actuation force F2 is applied to the linkage 902 in the direction shown, thereby rotating the idler arm, handle stanchion and handle 900 about the central vertical axis of the stanchion. Linkage may be joined to provide for simultaneous actuation of both handles with one actuator, or may be individually operable by separate actuators.

FIG. 14C is an exemplary diagram showing a top view of a portion of an exercise machine with handles and actuation linkage in a rotated and stowed position. In the fully actuated position, the actuator and linkage 902 having been fully extended, the handles 900 are now shown in the stowed position proximate to the lateral longitudinal edge of the exercise machine not shown. As is readily seen, the area between the handles has been maximized based on the separation of the handle stanchions, leaving the exercise platform substantially unobstructed and open for exercising without handles.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise machine with adjustable handles, suitable methods and materials are described above. All publications, patent applications, patents, and other references mentioned herein are incorporated by reference in their entirety to the extent allowed by applicable law and regulations. The exercise machine with adjustable handles may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine with adjustable handles, comprising:

a frame having a first end and a second end opposite of the first end;

a first stationary platform attached to the frame and positioned near the first end of the frame;

a carriage movably positioned upon the frame, wherein the carriage is adapted to be movable in a reciprocating manner along at least a portion of the frame;

a first rotatable handle rotatably positioned on the first stationary platform such that the first rotatable handle is rotatable about a first vertical axis, wherein the first rotatable handle is positioned near a first side of the first stationary platform; and a second rotatable handle rotatably positioned on the first stationary platform such that the second rotatable handle is rotatable about a second vertical axis, wherein the second rotatable handle is positioned near a second side of the first stationary platform;

wherein the first rotatable handle includes a first base having a center aligned with the first vertical axis and wherein the second rotatable handle includes a second base having a center aligned with the second vertical axis, wherein a first gripping surface of the first rotatable handle includes a first central axis that is off centered from the center of the first base, and wherein a second gripping surface of the second rotatable handle includes a second central axis that is off centered from the center of the second base.

2. The exercise machine of claim 1, wherein the first vertical axis is parallel with the second vertical axis.

3. The exercise machine of claim 1, wherein the first rotatable handle includes a first circular base and wherein the second rotatable handle includes a second circular base.

4. The exercise machine of claim 3, wherein the first circular base comprises a top surface that is substantially coplanar with a top surface of the first stationary platform, and wherein the second circular base comprises a top surface that is substantially coplanar with the top surface of the first stationary platform.

5. The exercise machine of claim 1, wherein the first rotatable handle and the second rotatable handle have a fixed dimension above a top surface of the first stationary platform.

6. The exercise machine of claim 1, wherein a first gripping surface of the first rotatable handle includes a first central axis, wherein a second gripping surface of the second rotatable handle includes a second central axis, and wherein the first central axis is substantially aligned with the second central axis when the first rotatable handle and the second rotatable handle are in a use position by an exerciser.

7. The exercise machine of claim 6, wherein the first central axis and the second central axis are both parallel with respect to a longitudinal axis of the frame when in a stowed position.

8. The exercise machine of claim 1, wherein the first central axis is substantially aligned with the second central axis when the first rotatable handle and the second rotatable handle are in a use position by an exerciser.

9. The exercise machine of claim 8, wherein the first central axis and the second central axis are both parallel with respect to a longitudinal axis of the frame when in a stowed position.

10. The exercise machine of claim 9, wherein the first rotatable handle and the second rotatable handle each have a cam-like rotation of the first gripping surface and the second gripping surface respectively when rotated from the use position to the stowed position.

11. The exercise machine of claim 10, wherein when the first rotatable handle and the second rotatable handle are in the stowed position the first stationary platform has an increased usable exercise platform area between the first rotatable handle and the second rotatable handle.

12. The exercise machine of claim 1, wherein an upper gripping portion of the first rotatable handle is offset from the first vertical axis and wherein an upper gripping portion of the second rotatable handle is offset from the second vertical axis.

13. The exercise machine of claim 1, including:

a third rotatable handle rotatably positioned on a second stationary platform attached to the frame such that the third rotatable handle is rotatable about a third vertical axis; and a fourth rotatable handle rotatably positioned on the second stationary platform such that the fourth rotatable handle is rotatable about a fourth vertical axis.

14. The exercise machine of claim 13, wherein the first vertical axis, the second vertical axis, the third vertical axis and the fourth vertical axis are parallel to one another.

15. An exercise machine with adjustable handles, comprising:

a frame having a first end and a second end opposite of the first end;

a first stationary platform attached to the frame and positioned near the first end of the frame;

a second stationary platform attached to the frame and positioned near the second end of the frame;

a carriage movably positioned upon the frame, wherein the carriage is adapted to be movable in a reciprocating manner along at least a portion of the frame;

a first rotatable handle rotatably positioned on the first stationary platform such that the first rotatable handle is rotatable about a first vertical axis, wherein the first rotatable handle is positioned near a first side of the first stationary platform;

a second rotatable handle rotatably positioned on the first stationary platform such that the second rotatable handle is rotatable about a second vertical axis, wherein the second rotatable handle is positioned near a second side of the first stationary platform;

a third rotatable handle rotatably positioned on the second stationary platform such that the third rotatable handle is rotatable about a third vertical axis; and a fourth rotatable handle rotatably positioned on the second stationary platform such that the fourth rotatable handle is rotatable about a fourth vertical axis;

wherein the first vertical axis is parallel with the second vertical axis;

wherein a first gripping surface of the first rotatable handle includes a first central axis, wherein a second gripping surface of the second rotatable handle includes a second central axis, and wherein the first central axis is substantially aligned with the second central axis when the first rotatable handle and the second rotatable handle are in a use position by an exerciser;

wherein the first central axis and the second central axis are both parallel with respect to a longitudinal axis of the frame when in a stowed position.

16. The exercise machine of claim 15, wherein the first vertical axis, the second vertical axis, the third vertical axis and the fourth vertical axis are parallel to one another.

17. The exercise machine of claim 15, wherein an upper gripping portion of the first rotatable handle is offset from the first vertical axis and wherein an upper gripping portion of the second rotatable handle is offset from the second vertical axis.

18. An exercise machine with adjustable handles, comprising:

a frame having a first end and a second end opposite of the first end;

a first stationary platform attached to the frame and positioned near the first end of the frame;

a second stationary platform attached to the frame and positioned near the second end of the frame;

a carriage movably positioned upon the frame, wherein the carriage is adapted to be movable in a reciprocating manner along at least a portion of the frame;

a first rotatable handle rotatably positioned on the first stationary platform such that the first rotatable handle is rotatable about a first vertical axis, wherein the first rotatable handle is positioned near a first side of the first stationary platform;

a second rotatable handle rotatably positioned on the first stationary platform such that the second rotatable handle is rotatable about a second vertical axis, wherein the second rotatable handle is positioned near a second side of the first stationary platform;

a third rotatable handle rotatably positioned on the second stationary platform such that the third rotatable handle is rotatable about a third vertical axis, wherein the third rotatable handle is positioned near a first side of the second stationary platform; and a fourth rotatable handle rotatably positioned on the second stationary platform such that the fourth rotatable handle is rotatable about a fourth vertical axis, wherein the fourth rotatable handle is positioned near a second side of the second stationary platform;

wherein the first vertical axis, the second vertical axis, the third vertical axis and the fourth vertical axis are parallel to one another;

wherein a first gripping surface of the first rotatable handle includes a first central axis, wherein a second gripping surface of the second rotatable handle includes a second central axis, and wherein the first central axis is substantially aligned with the second central axis when the first rotatable handle and the second rotatable handle are in a use position by an exerciser;

wherein the first central axis and the second central axis are both parallel with respect to a longitudinal axis of the frame when in a stowed position;

wherein an upper gripping portion of the first rotatable handle is offset from the first vertical axis, wherein an upper gripping portion of the second rotatable handle is offset from the second vertical axis, wherein an upper gripping portion of the third rotatable handle is offset from the third vertical axis and wherein an upper gripping portion of the fourth rotatable handle is offset from the fourth vertical axis;

wherein when the first rotatable handle and the second rotatable handle are in the stowed position the first stationary platform has an increased usable exercise platform area between the first rotatable handle and the second rotatable handle.

19. An exercise machine with adjustable handles, comprising:

a frame having a first end and a second end opposite of the first end;

a first stationary platform attached to the frame and positioned near the first end of the frame;

a carriage movably positioned upon the frame, wherein the carriage is adapted to be movable in a reciprocating manner along at least a portion of the frame;

a first rotatable handle rotatably positioned on the first stationary platform such that the first rotatable handle is rotatable about a first vertical axis, wherein the first rotatable handle is positioned near a first side of the first stationary platform;

a second rotatable handle rotatably positioned on the first stationary platform such that the second rotatable handle is rotatable about a second vertical axis, wherein the second rotatable handle is positioned near a second side of the first stationary platform;

a third rotatable handle rotatably positioned on a second stationary platform attached to the frame such that the third rotatable handle is rotatable about a third vertical axis; and a fourth rotatable handle rotatably positioned on the second stationary platform such that the fourth rotatable handle is rotatable about a fourth vertical axis.

20. The exercise machine of claim 19, wherein the first vertical axis, the second vertical axis, the third vertical axis and the fourth vertical axis are parallel to one another.

* * * * *